United States Patent [19]

Prince et al.

[11] Patent Number: 4,822,297

[45] Date of Patent: Apr. 18, 1989

[54] JUNCTION BLOCK

[75] Inventors: Thomas F. Prince, Milton; Julian J. Bishop, Belmont, both of Mass.; William B. Walkup, Amherst, N.H.

[73] Assignee: Ark-Les Corporation, Watertown, Mass.

[21] Appl. No.: 487,618

[22] Filed: Apr. 22, 1983

[51] Int. Cl.[4] ..... H01R 4/24; H01R 13/506

[52] U.S. Cl. ..... 439/395; 439/399; 439/404; 439/620; 439/731; 439/834; 439/862

[58] Field of Search ..... 339/97 R, 97 P, 97 T, 339/98, 99 R, 150 T, 154 R, 156 R, 175 R, 150 R, 151 R, 157 R, 175 C, 163, 164 R, 164 M, 182 R, 183, 65, 66 R, 66 M

[56] References Cited

U.S. PATENT DOCUMENTS

| | | | |
|---|---|---|---|
| 2,720,635 | 10/1955 | Odegaard | 339/99 R |
| 2,738,482 | 3/1956 | Benander | 339/164 R |
| 2,892,174 | 6/1959 | Benander | 339/175 C X |
| 3,118,715 | 1/1964 | Potrvch | 339/175 R X |
| 3,536,870 | 10/1970 | Izumi | 339/183 X |
| 3,910,672 | 10/1975 | Frantz | 339/97 P |
| 4,148,540 | 4/1979 | Hayes | 339/99 R |
| 4,262,983 | 4/1981 | Bogese, II | 339/97 C |
| 4,274,699 | 6/1981 | Keim | 339/176 MP |
| 4,386,820 | 6/1983 | Dola et al. | 339/99 R X |

FOREIGN PATENT DOCUMENTS

| | | | |
|---|---|---|---|
| 86390 | 5/1936 | Sweden | 339/150 T |

*Primary Examiner*—Gil Weidenfeld
*Assistant Examiner*—Steven C. Bishop
*Attorney, Agent, or Firm*—Sylvia L. Boyd

[57] ABSTRACT

A junction block for tap-in connection to a continuous two-conductor line comprises a removably mutually engageable base and a cover, defining axially aligned wire entrance and exit apertures, and a passage admitting a plug. Conductor positioners each define a conductor path between the apertures; insulation displacement means are positioned for cooperative interaction with the positioners. Each displacement means is electrically connected with a contact spring adjacent the passage.

A positioner and its cooperating displacement means together define a conductor engagement position generally on a level with the wire apertures, so that tension on the wire external to the block does not tend to pull the conductors out of the displacement means. The block has cooperating alignment means mutually engageable during assembly positively to align the positioners with the displacement means before the conductor insulation is engaged, and to prevent misassembly of the block components.

4 Claims, 3 Drawing Sheets

JUNCTION BLOCK

BACKGROUND OF THE INVENTION

This invention relates to communications networks, particularly local area networks connecting office data processing equipment. In particular, it relates to a junction block permitting tap-in connection to a continuous communication line, for example of twisted-pair or other two-conductor wire.

In the rapidly growing field of office automation, using electronic data processing equipment, there is a growing use of local area networks, serving, for example, a single office building or portion of a building. In such networks, there is increasing use of twisted-pair wire as the communications line. Generally, when the network is installed in a building, such wire is strung throughout the building, for example, at baseboard level, and thereafter the equipment to be included in the network is connected to the communications line. Frequently, after installation, equipment is moved from office to office; additionally, it may be desirable to connect new equipment onto the line after the original installation.

In such cases, there is need for a simple means for removably connecting the office equipment to the communications line. Such means may take the form of a junction block connected to the line, accepting a conventional plug or similar plug-in terminal structure from the equipment to be connected into the line.

Prior art devices for such connection have had various disadvantages. Many such devices have required that the communications line be severed, each free end being stripped and prepared (as by twisting the wires comprising the conductor), and the prepared ends being separately connected (as by winding around a post) to terminals in the junction block. This process, to be accomplished reliably, requires a certain amount of technical expertise, which means that the ordinary office personnel are frequently not able to make the connection and therefore cannot freely move equipment around the office. Further, the process is time-consuming. In addition, the fact that the line is severed and connected through terminals means that the resistance of the line is increased by the presence of an additional connection. Finally, a connection made in this way is not easily reversible.

It is therefore an object of this invention to provide a junction block permitting tap-in connection to a twisted-pair communications line that does not require the line to be severed, that can be easily employed by persons without technical experience, and without using special tools, whose parts cannot be misassembled, and that adds only minimal resistance to the line. It is also an object to provide such a block that can be removed if desired, and that is reusable.

A further object of the invention is to provide a junction block means for connecting into a two-conductor local area network that has superior capacity to preserve the connection when subjected to axial tension on the line from outside the block.

It is also an object of the invention to provide such a junction block that is inexpensive to manufacture. Further, it is an object to provide a junction block that can easily be provided with a resistor to stimulate a full line, but that can thereafter be easily and nondestructively opened to remove the resistor and connect equipment into the network through the same block.

SUMMARY OF THE INVENTION

According to the invention, a junction block provides a tap-in connection to a network line of continuous wire comprising an insulating sheath and two conductors, each conductor being separately enclosed in an insulation layer and carried within the sheath. The junction block comprises a base and a cover removably mutually engageable to define a junction block body in an assembled condition. The base and cover each have an interior floor and perimeter wall portions; the base and cover perimeter wall portions abut together in the assembled condition to form a block perimeter wall.

The base and cover perimeter wall portions provide cooperating wire-support structures. The wire-support structures in the block assembled condition define generally axially aligned wire entrance and exit apertures. The base provides two conductor positioners each defining a conductor path between the apertures generally parallel with the base floor and with the axis of the apertures, the two defined conductor paths being of generally similar length.

The cover provides two electrically conductive insulation displacement means each positioned for cooperative interaction with a conductor positioner in the block assembled condition, each insulation displacement means being dimensioned to engage a wire conductor through its insulation layer. A conductor positioner and a cooperating insulation displacement means in the block assembled condition together define a conductor engagement position generally on a level with the axially aligned wire entrance and exit apertures.

The cover further provides two contact springs, each insulation displacement means being electrically connected with a contact spring; the contact springs are adjacent one another but electrically separated. The cover and base further provide cooperating alignment means mutually engageable during assembly of the base and cover and while the conductor positioners and cooperating insulation displacement means remain spaced apart, positively to align the conductor positioners with the insulation displacement means for interaction therewith. The junction block in its assembled condition further provides a plug-admitting passage adjacent the contact springs, for admitting a plug into electrical connection therewith.

In preferred embodiments, the base wire-support structure has a wire-supporting surface spaced inwardly from the base floor by a wire-spacing distance, and each conductor positioner further provides conductor support mean spaced inwardly from the base floor by a distance generally equal to the wire-spacing distance. The cover wire-support structure has a wire-supporting surface spaced inwardly from the cover floor by the wire-spacing distance. Each conductor positioner further provides conductor aligning structure oriented generally parallel with the axis of the wire apertures, having an interior dimension sized to provide an interference fit with a conductor enclosed in an insulating layer. The insulation displacement means has opposed interior conductor-engaging edges and an interior edge connecting them, curved concavely away from and spaced inwardly from the cover floor by a distance generally equal to the wire-spacing distance. The insulation displacement means interior curved edge and the conductor positioner conductor support means together define the conductor engagement position in the block assembled condition.

Each conductor positioner further provides receiving means extending generally normal to the base floor and transverse to the defined conductor path, the cooperating insulation displacement means being positioned to be received in the receiving means in the block assembled condition.

The junction block further provides first and second contact spring support structures, which in the block assembled condition are each positioned to limit travel of a contact spring away from the plug-admitting passage.

Other objects, features and advantages will appear from the following detailed description of a preferred embodiment, taken together with the drawing, in which:

DRAWINGS

DESCRIPTION OF THE PREFERRED EMBODIMENT

Figure 1:
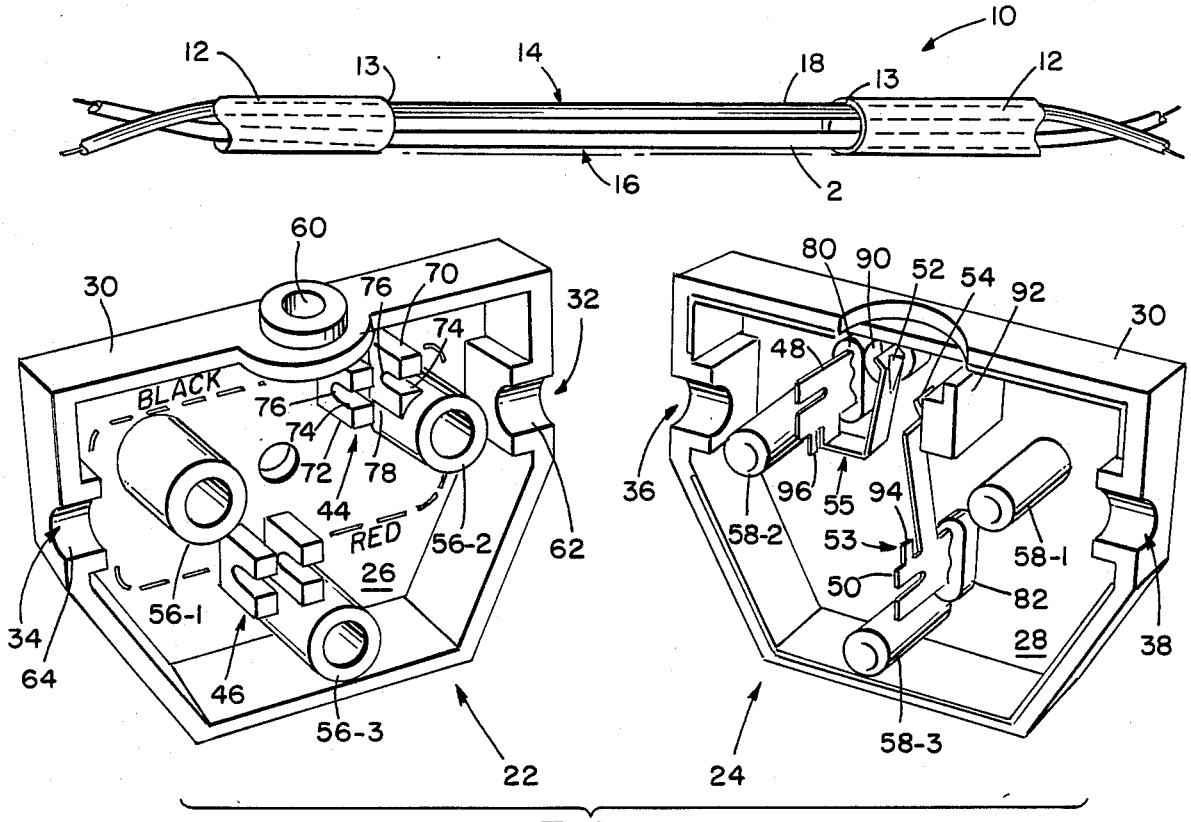
FIG. 1 is a perspective view of the components of the junction block of the invention, in disassembled condition, together with a respective piece of twisted-pair wire to be tapped into.

Referring now to the drawing, and in particular to FIG. 1, the junction block of the invention provides tap-in connection to a line of continuous twisted-pair wire 10 comprising an insulating sheath 12 and two conductors 14 and 16. Conductor 14 is enclosed in an insulation layer 18, and conductor 16 is separately enclosed in an insulation layer 20; both conductors are carried within sheath 12. A layer of braid shielding or a separate drain wire may surround or parallel the two conductors.

Figure 2:
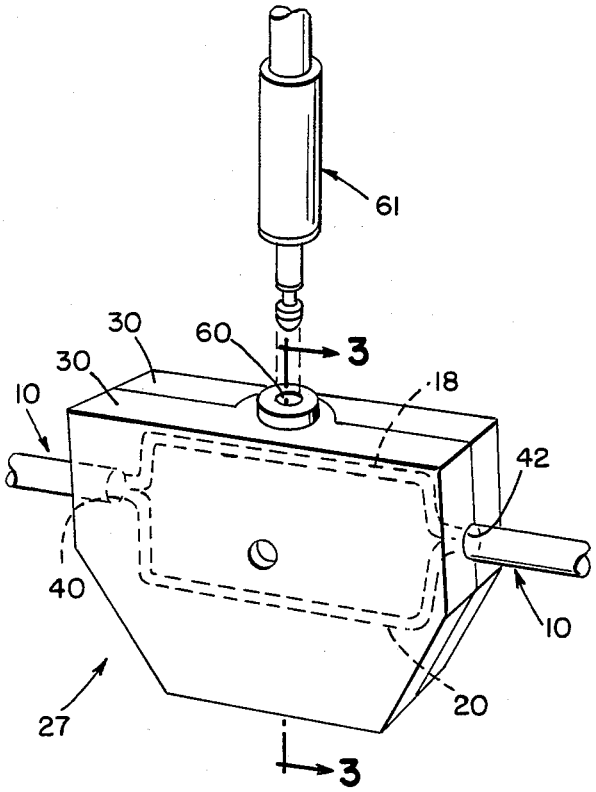
FIG. 2 is a perspective view of the junction block of the invention in assembled condition, together with a plug suitable to be plugged into the block.
Figure 7:
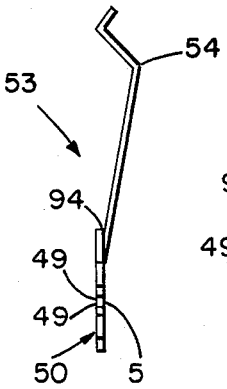
FIGS. 7 through 10 are detail views of particular components of the junction block of the invention.
Figure 4:
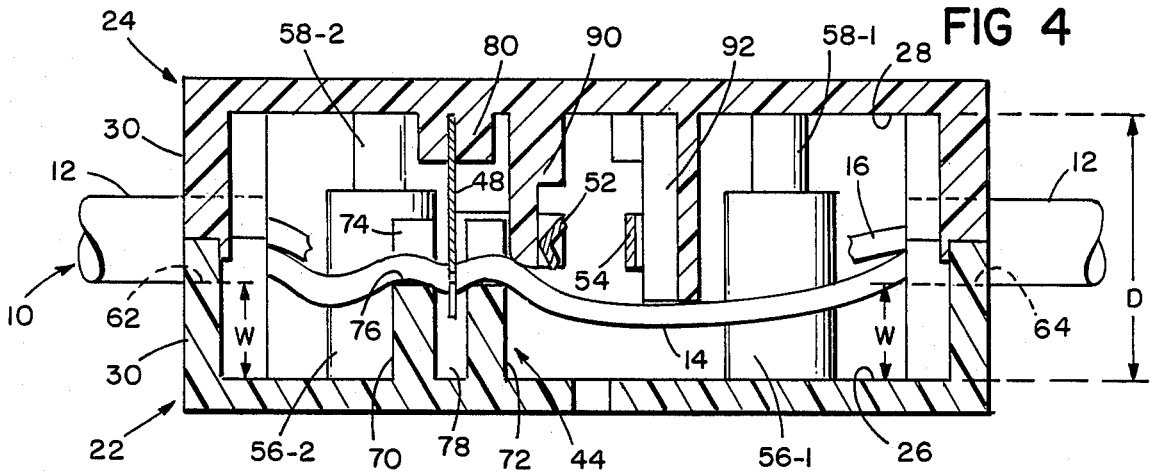
FIG. 4 is a sectional view taken on line 4—4 of FIG. 3.

The junction block comprises a base 22 and a cover 24 which are removably mutually engageable to define in an assembled condition a junction block body 26 (as seen in FIG. 2). Base 22 has an interior floor 26, and cover 24 has an interior floor 28. Both base and cover have perimeter wall portions 30, which in the assembled condition of the junction block abut together (as seen in FIG. 2) to form a block perimeter wall and to define a minimum spacing between floors 26 and 28. The defined minimum spacing is indicated in FIG. 4 by the letter D.

The base and cover perimeter wall portions 30 provide cooperating wire-support structures 32 and 34 (in base 22) and 36 and 38 (in cover 24). In the assembled condition of the junction block, structures 32 and 36 cooperate to define a wire entrance aperture 40, while structures 34 and 38 cooperate to define a wire exit aperture 42 (indicated in FIG. 2). As best seen in FIG. 2, entrance aperture 40 and exit aperture 42 are generally axially aligned.

Figure 5:
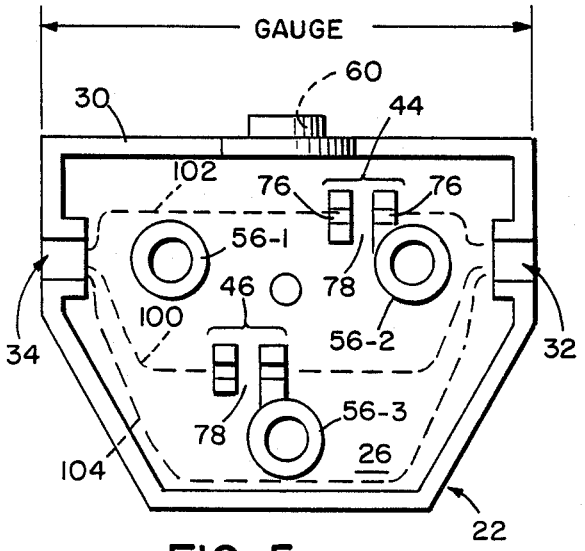
FIG. 5 is a plan view of a first block component.

Base 22 further provides two conductor positioners generally indicated at 44 and 46. Each conductor positioner defines a conductor path between apertures 40 and 42. The conductor paths, as will appear more clearly in what follows, are generally parallel with base floor 26 and with the axis of the apertures, are generally on a level with the apertures, and are of generally similar length. The conductor paths are generally indicated by the dashed lines 100 and 102 (FIG. 5).

Cover 24 provides two electrically conductive insulation displacement means generally indicated at 48 and 50. Each of displacement means 48 and 50 has opposed interior edges 49 (FIGS. 7, 8, 9 and 10) dimensioned to engage the conductor within the insulation layer 18 or 20. Displacement means 48 is positioned for cooperative interaction with conductor positioner 44, and displacement means 50 is positioned for cooperative interaction with conductor positioner 46. Displacement means 48 is electrically connected with a spring contact 52, and displacement means 50 is electrically connected with a spring contact 54; spring contacts 52 and 54, in the assembled condition of the junction blocks (FIGS. 3 and 6) are adjacent a plug-admitting passage 60. Spring contacts 52 and 54 are adjacent one another but electrically separated, for the reception of a conventional plug 61.

Figure 11:
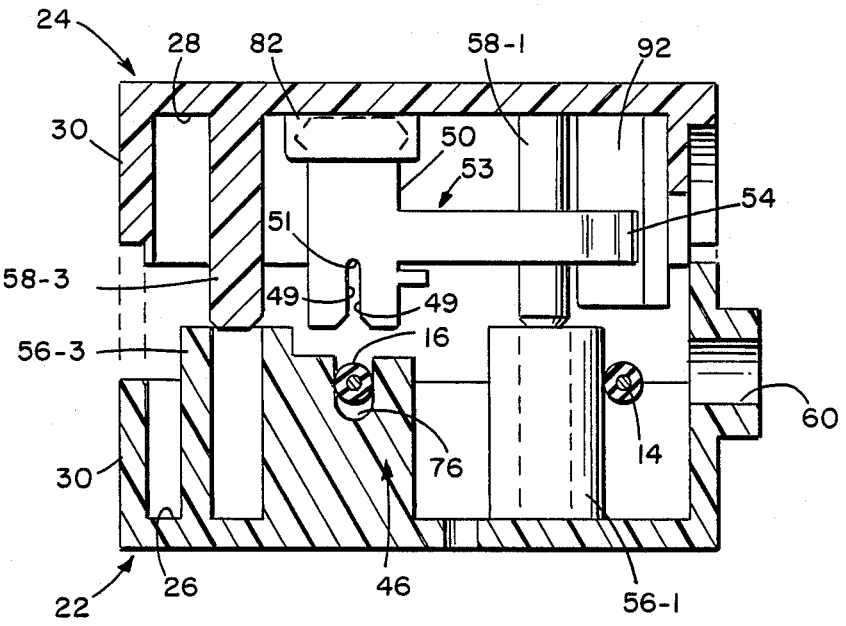
FIG. 11 shows elements of the block as they are positioned during assembly of the block.

Base 22 and cover 24 further provide cooperative alignment means, comprising three turrets 56-1, 56-2, 56-3 carried on base 22 and three pins 58-1, 58-2, 58-3 carried on cover 24. Referring to FIG. 11, the heights of the turrets and pins are such that, as the cover and base are approached together to assemble the junction block, the turrets and pins engage one another before either insulation displacement means engages a conductor carried in the corresponding conductor positioner. In this way, the insulation displacement means are positively aligned with the conductor positioners (and with the conductors carried therein) before the displacement means actually engages the insulation layer. Thus, in the event that the cover and base are incorrectly aligned, the insulation cannot be engaged by the insulation displacement means. Therefore, the misalignment can be easily corrected, without having weakened the line or breached the insulation on the conductors.

Figure 3:
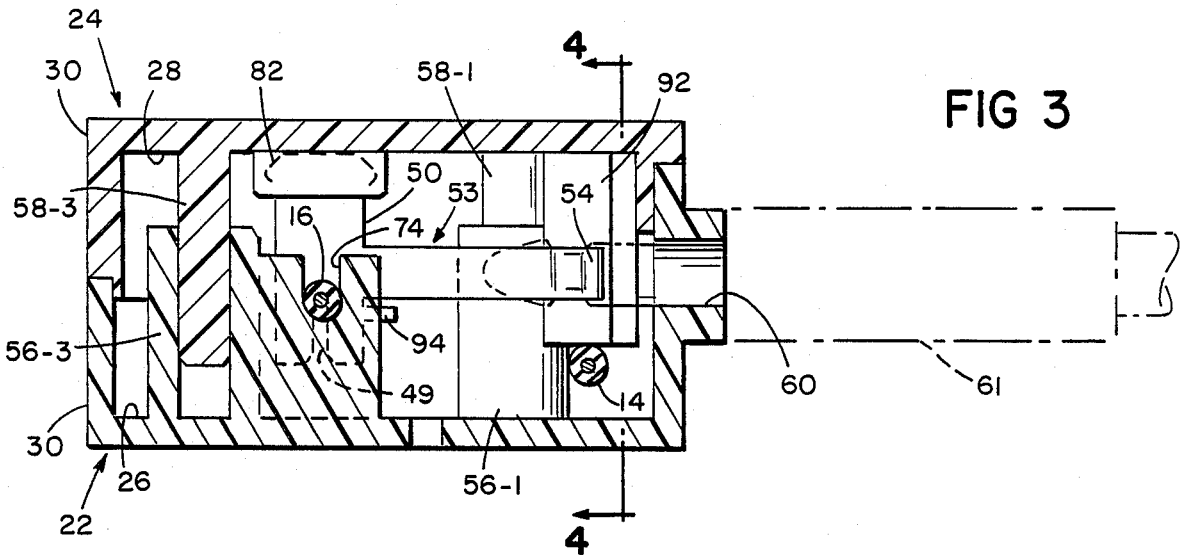
FIG. 3 is a sectional view taken on line 3—3 of FIG. 2, and indicating the position of the plug in the block.

In the assembled condition of the block, a conductor positioner 44 or 46 and its cooperating insulation displacement means 48 or 50 together define the final position in which the conductor is retained, its insulation being cut and the conductor electrically engaged by the interior edges 49 of the insulation displacement means. As seen in FIGS. 3 and 4, such engagement position of the conductor is generally on a level with the wire entrance and exit apertures of the junction block.

More in detail, and referring first to base 22 and its associated components, base wire support structures 32 and 34 have cylindrical wire-supporting surfaces 62 and 64 respectively, spaced inwardly from base floor 26 by a distance indicated by the letter W on FIG. 4, and referred to as the wire-spacing distance. Wire support structure thereby maintains the twisted-pair wire 10 (in its sheath 12) spaced by a distance W from base floor 26.

Conductor positioner 44 in the specific embodiment herein disclosed comprises a pair of adjacent and similar posts 70 and 72. Post 70 and 72 each provide a groove 74 having an upwardly curved bottom surface 76, spaced inwardly from base floor 26 by a distance generally equal to the wire-spacing distance W. The straight inner surfaces of grooves 74 are oriented generally parallel with the axis of entrance and exit apertures 32 and 34, and are spaced apart by a distance such that grooves 74 provide an interference fit with a conductor enclosed in an insulating layer. Bottom surfaces 76 of grooves 74 define conductor support means; the inner surfaces of groove 74 define conductor aligning means.

Posts 70 and 72 are spaced apart to define receiving means 78, generally medial within the conductor positioner and oriented transverse to the defined conductor path, and normal to base floor 26. The function of means 78 will appear in what follows.

Conductor positioner 46 is similar in design and orientation of its parts to positioner 44.

As seen in FIG. 5, indicia ("RED" and "BLACK" in the present embodiment, but suitable to the colors of the two conductors in the wire actually employed) are provided on base floor 26, associated with the conductor paths (indicated by dashed lines 100 and 102).

Referring now to cover 24 and its associated components, as seen in FIGS. 7 through 10, in the preferred embodiment insulation displacement means 50 and spring contact 54 are integrally formed as a terminal 53, having a lower edge 57. Similarly, insulation displacement means 48 and spring contact 52 are integrally formed as a terminal 55, having a lower edge 59. Terminals 53 and 55 are formed out of metal stock of suitable gauge. Opposed interior edges 49 of each insulation displacement means 48 or 50 are joined by a curved edge portion 51, concave away from the cover floor.

Cover 24 provides displacement means supports 80 and 82. Terminal lower edges 57 and 59 are received in displacement means supports 80 and 82, respectively (FIG. 6), and retained by an interference fit, to position a supported displacement means generally normal to cover floor 28, and transverse to a defined conductor path. When the displacement means is so positioned in a support 80 or 82, the displacement means curved edge portion 51 is spaced inwardly from cover floor 50 by a distance generally equal to the wire-spacing distance W.

As will be seen, in the assembled condition of the junction block, a conductor is maintained by curved edge portion 51 of the appropriate insulation displacement means and by the bottom surfaces 76 of the appropriate conductor positioner in a position spaced generally equally from the two interior floors 26 and 28, and generally level with the entrance and exit apertures.

Cover 24 further provides contact spring support structures 90 and 92, adjacent plug passage 60; contact spring 52 is supported against structure 90, and contact spring 54 is supported against structure 92. This arrangement provides necessary contact pressure and plug retention. Because of this arrangement, the insulation displacement means and contact spring structures may be made of a relatively thin stock, contributing to the overall economy of manufacture of the junction block.

In the assembled condition of the block, structure 92 extends toward base floor 26 far enough to push the conductor aligned by means 44 inwardly away from contact spring 54 and thereby to prevent the conductor insulation from being cut by contact spring 54. Structures 90 and 92 are preferably integrally molded with cover 24.

Figure 8:
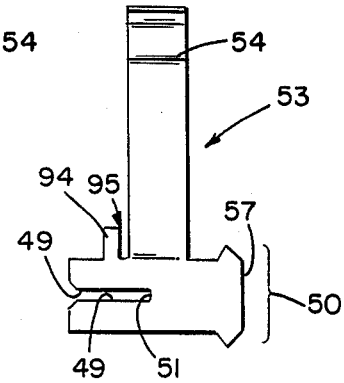
Figure 9:
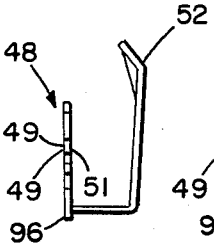
Figure 10:
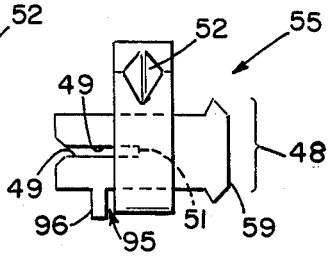
Figure 6:
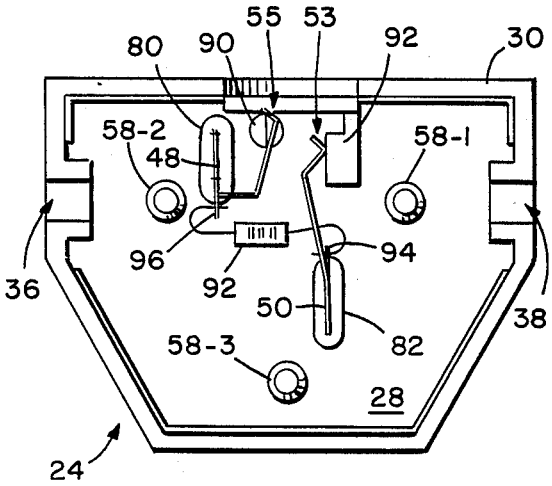
FIG. 6 is a plan view of a second block component.

Referring now to FIGS. 8 and 10, insulation displacement means 50 provides a tab 94, and insulation displacement 48 provides a tab 96. Each of tabs 94 and 96 defines with respect to the remainder of its associated terminal (53 or 55 respectively) a spacing 95, chosen to provide an interference fit with a resistor lead, and thereby to provide a gas-tight connection between the resistor and the spring contact of the terminal. As is best seen in FIG. 6, when the junction block is in the last position on the local area network line, a suitable resistor 98 may be connected, either by such interference fit of its lead in spacing 94, or by soldering, between terminals 53 and 55.

In using the junction block of the invention, a twisted-pair wire is prepared as seen in FIG. 1, by removing a section of insulating sheath 12 of a length somewhat greater than the distance separating the entrance and exit apertures 40 and 42. For this purpose, the width of either cover or base serves as a gauge, as seen in FIG. 5. The sheath section is removed by making two circular cuts around the sheath spaced apart by the gauge distance shown in FIG. 5, and a linear cut connecting them, all without severing the conductors carried within the sheath. If a braid shield is present, it is combed out and placed between turret 56-3 and the adjacent portion of the base perimeter wall. A path for the braid shield, or for a separate drain wire, is indicated in FIG. 5 by dashed line 104.

The two insulated conductors are separated, and according to the color of their insulation and the indicia ("BLACK" or "RED"), are placed in the appropriate conductor positioner means 44 or 46. The sheathed ends 13 are placed in wire-support structures 32 and 34 of base 22. (The additional path length introduced by the spacing of positioners 44 and 46 away from the axis of apertures 40 and 42 is such that the portions of wire 10 supported in apertures 40 and 42 are within the sheath ends 13). Conductors 14 and 16 are positioned in conductor paths 100 and 102 and in particular a portion of each conductor is positioned generally parallel with the axis of the entrance and exit apertures, and spaced above floor 26 by the wire-spacing distance W, and thus generally on a level with apertures 40 and 42.

Cover 24 is then aligned with base 22, by means of cooperative alignment means 56 and 58. The cover and base cannot be closed in incorrect alignment; as seen in FIG. 11, the alignment is determined before the insulation displacement means 48 and 50 engage the conductors held in conductor positioners 44 and 46. As the cover and base are closed to assemble the junction block body, insulation displacement means 48 and 50 are received in receiving means 78 of the conductor positioners, so that means 48 and 50 cut into the insulation of conductors 14 and 16 generally transverse to the conductor paths. Edges 49 of insulation displacement means 48 and 50 slice into the insulation of the conductors to make the necessary electrical connection, and as the cover and base perimeter walls are butted together, the conductors are captured against further vertical movement between surfaces 76 of the conductor positioners, and curved edges 51 of the insulation displacement means.

As is seen particularly for conductor positioner 46 and cooperating insulation displacement means 50 in FIG. 3, and for conductor positioner 44 and cooperating insulation displacement means 48 in FIG. 4, these elements cooperate to insure that the conductors 14 and 16 are engaged by the insulation displacement means (forming the electrical connection) at a position generally on a level with entrance and exit apertures 40 and 42. This is advantageous, because if a conductor were significantly removed from such level at the point of the electrical connection, axial tension on wire 10 external to the junction block 27 would tend to pull the conductors toward such a level position. Such motion would tend to pull the conductors out of electrical connection and thereby to impair the function of the block. The structure of the present invention therefore advantageously tends to provide a connection to the network line that is resistant to degradation by such axial tension on the line.

The base and cover of the junction block are held together essentially by the friction between the insulation displacement means and the conductors. Thus the block is easily opened at any time, without injury to the block or to the conductors.

When a particular junction block is in the last position on the local area network line, a suitable resistor 98 may be connected, by interference fit in spaces 95 or by soldering, between terminals 53 and 55. Because of the presence of resistor 98, the communication line is "seen" by transmitting equipment connected to the line as being "full". If it is desired to add further equipment to the communication line, the junction block of the invention is easily opened without injury to either the conductors or the block (because of the design of the block components according to the present invention), and by severing tabs 94 and 96 the resistor is easily removed. Any appropriate equipment can then be tapped into the line by inserting its plug into plug passage 60.

It will be apparent that the junction block of the invention is not confined to use with twisted-pair wire, but is useful in providing connection with other two-conductor wires. Further, the junction block of the invention could be easily modified, without departing from the invention, to be used within three-conductor wire, by providing a third wire positioner and a third terminal comprising insulation displacement means and spring contact, appropriately positioned with respect to the plug passage.

What is claimed is:

1. For providing tap-in electrical connection to an unsevered non-terminal portion of two-conductor wire comprising an insulating sheath and two conductors, each conductor being separately enclosed in an insulation layer and carried within the sheath, a junction block comprising a conductor-positioning part and a tap-in part, said conductor-positioning part comprising first and second connection locating structures, each defining a retaining channel for positioning and retaining a medial length of an unsevered insulated conductor of a non-terminal length of two-conductor wire extending beyond said block in two directions, and a blade support channel transversely crossing said retaining channel, said retaining channel and said blade support channel comprising a pair of medially crossing mutually transverse channels, said tap-in part providing first and second slicing and gripping connectors for making electrical connection with a conductor enclosed in an insulation layer and retained by a corresponding said retaining channel, each said slicing and gripping connector comprising a bifurcated blade providing a wedging edge comprising opposed interior conductor-engaging slicing edges and an interior concave edge coplanar with and connecting said opposed edges, said blade further providing opposed lead-in edges each adjacent and coplanar with a said conductor-engaging slicing edge and at an angle thereto and spaced from said concave edge, said conductor-positioning part and said tap-in part providing cooperating prepositioning structure sized and dimensioned for preliminary mutually aligning engagement in the absence of engagement of either said slicing and gripping connector with the insulation layer of a corresponding retained conductor, said prepositioning structure in said preliminary engagement preventing further relative travel of said conductor-positioning part and said tap-in part other than in that orientation in which each said slicing and gripping connector blade is aligned for entry into a corresponding said blade support channel, during said further relative travel, said lead-in edges of a said slicing and gripping connector blade entering said blade support channel and tangentially engaging the insulating layer of a conductor retained by the corresponding said retaining channel, for initial slicing of circumferential portions of the insulating layer, each said slicing and gripping connector blade being positioned in said tap-in part for wedging a circumferential portion of a corresponding retained conductor against said blade wedging edge, said conductor-positioning part, said tap-in part, said pairs of medially crossing mutually transverse channels, and said slicing and gripping connector blades being sized and dimensioned with respect to each other and with respect to the conductor to be tapped into to terminate said further relative travel of said parts at an assembled engagement position in which said block is closed and each said wedging edge electrically engages and positively grips the corresponding retained conductor through its insulating layer to provide a gas-tight connection, and such that retention of conductors by said retaining channels, and engagement of the retained conductors by said corresponding wedging edges, is effective to hold said conductor-positioning part and said tap-in part in assembled engagement without other means for holding.

2. The junction block of claim 1, said first and second connection locating structures being integrally molded with said block positioning part, and in said assembled engagement position, said blade support channel being sized and positioned to be effective to limit blending or twisting displacement of a said slicing and gripping connector blade lengthwise of a wedged conductor retained in the corresponding said mutually crossing retaining channel, for support of the electrical connection at the connection location and resistance to disassembly of the connection in response to tension exerted on said wire external to said block.

3. The junction block of claim 1, said conductor-positioning part and said tap-in part cooperatively providing two aligned wire entrance structures through which the two-conductor wire enters and leaves said block, said block further providing an aperture for admitting a two-conductor tap-in line, and plug-contacting means for connecting each of the conductors of said tap-in line respectively to a said slicing and gripping connector.

4. The junction block of claim 1, further providing contact support structure supporting said plug-contacting means adjacent to the regions in which they contact said slicing and gripping connectors.

* * * * *

UNITED STATES PATENT AND TRADEMARK OFFICE
CERTIFICATE OF CORRECTION

PATENT NO. : 4,822,297
DATED : April 18, 1989
INVENTOR(S) : Thomas F. Prince, et al

It is certified that error appears in the above-identified patent and that said Letters Patent is hereby corrected as shown below:

Col. 1, line 67, "stimulate" should read --simulate- .

Col. 2, lines 5-6, "provides a tap-in" should read --provides tap-in--.

Col. 3, line 22, "respective" should read --representative--.

Col. 4, line 24, "blocks" should read --block--.

Col. 4, line 66, "Post 70 and 72" should read --Posts 70 and 72--.

Signed and Sealed this

Tenth Day of April, 1990

*Attest:*

HARRY F. MANBECK, JR.

*Attesting Officer*

*Commissioner of Patents and Trademarks*